US007036631B2

(12) United States Patent
Feik et al.

(10) Patent No.: US 7,036,631 B2
(45) Date of Patent: May 2, 2006

(54) WHEEL ATTACHMENT FOR LADDER

(75) Inventors: Frederick G. Feik, Maple Plain, MN (US); Bruce D. Clark, Maple Plain, MN (US)

(73) Assignee: American Innovations, Inc., Long Lake, MN (US)

( * ) Notice: Subject to any disclaimer, the term of this patent is extended or adjusted under 35 U.S.C. 154(b) by 0 days.

(21) Appl. No.: 10/947,697

(22) Filed: Sep. 23, 2004

(65) Prior Publication Data

US 2005/0034923 A1 Feb. 17, 2005

Related U.S. Application Data

(63) Continuation-in-part of application No. 10/215,238, filed on Aug. 8, 2002, now abandoned.

(60) Provisional application No. 60/311,721, filed on Aug. 10, 2001.

(51) Int. Cl.
*E06C 5/00* (2006.01)
*E06C 5/32* (2006.01)

(52) U.S. Cl. ..... 182/129; 182/127

(58) Field of Classification Search ..... 182/129, 182/127, 22, 165, 13–17, 20, 39, 107, 214, 182/206, 108, 109, 172, 230; 248/210, 238; 280/30, 47.17, 47.18, 47.24, 47.29, 645; 16/29

See application file for complete search history.

(56) References Cited

U.S. PATENT DOCUMENTS

| | | | | |
|---|---|---|---|---|
| 2,570,656 A | | 1/1948 | Dustin et al. | 9/1 |
| 3,667,085 A | | 6/1972 | Cumella et al. | 16/30 |
| 3,954,155 A | * | 5/1976 | Guidara | 182/20 |
| 4,009,762 A | * | 3/1977 | Bjerkgard | 182/20 |
| 4,049,283 A | | 9/1977 | Brookes et al. | 280/47.13 R |
| 4,227,281 A | | 10/1980 | Chung et al. | 16/29 |
| 4,448,282 A | * | 5/1984 | Giezendanner | 182/22 |
| D274,945 S | | 7/1984 | Fitch | D25/68 |
| 4,485,983 A | | 12/1984 | Berzbach | 182/234 |
| 4,564,203 A | | 1/1986 | Wilson | 280/47.32 |
| 4,614,349 A | | 9/1986 | Wenzel | 280/47.18 |
| 4,719,663 A | | 1/1988 | Termini | 16/30 |
| 4,843,678 A | | 7/1989 | Park | 16/30 |
| 5,086,872 A | | 2/1992 | Lin | 182/18 |
| 5,566,780 A | | 10/1996 | Bambrough | 182/116 |
| 5,727,799 A | | 3/1998 | DiSario | 280/47.3 |
| 5,740,584 A | | 4/1998 | Hodge et al. | 16/30 |
| 5,779,250 A | | 7/1998 | Becht | 280/414.2 |
| 5,833,028 A | | 11/1998 | Ramsey et al. | 182/129 |
| 5,882,023 A | | 3/1999 | Swager | 280/47.131 |
| 5,934,639 A | | 8/1999 | Chiang et al. | 248/346.11 |
| D431,081 S | | 9/2000 | Johansson et al. | D25/68 |
| 6,161,850 A | | 12/2000 | James et al. | 280/47.18 |
| 6,328,330 B1 | | 12/2001 | Haaser | 280/645 |
| 6,352,135 B1 | | 3/2002 | Jones | 182/129 |

(Continued)

*Primary Examiner*—Hugh B. Thompson, II
(74) *Attorney, Agent, or Firm*—Westman, Champlin & Kelly, P.A.

(57) ABSTRACT

A wheeled dolly or support for a ladder is made in two pieces, including a base plate that permanently affixes to an outside surface of a rail of a ladder, and a frame that is removably mounted on the base plate. The frame carries wheels that will support the ladder when the ladder is placed on edge and one end of the ladder is lifted. The frame normally is near a base end of the ladder. The frame that holds the wheels can be removed when desired for storage, or for use in a location where the wheels may restrict clearance around the ladder.

14 Claims, 4 Drawing Sheets

U.S. PATENT DOCUMENTS 6,361,057 B1 3/2002 Carter ..... 280/63
6,405,829 B1 * 6/2002 Barnett ..... 182/107
6,585,084 B1 * 7/2003 Gannon ..... 182/129
6,592,133 B1 7/2003 Powell ..... 280/79.11
6,592,134 B1 7/2003 Abraham ..... 280/79.7
6,688,426 B1 * 2/2004 Mikros ..... 182/17

* cited by examiner

WHEEL ATTACHMENT FOR LADDER

This application is a continuation-in-part of U.S. patent application Ser. No. 10/215,238, filed Aug. 8, 2002, now abandoned and priority is claimed on patent application Ser. No. 10/215,238, now abandoned which in turn refers to and claims priority from U.S. Provisional Application Ser. No. 60/311,721, filed Aug. 10, 2001, and priority based on Provisional Application Ser. No. 60/311,721 is also claimed in this application and the contents of which is incorporated by reference.

BACKGROUND OF THE INVENTION

This application relates to a set of wheels that can mount onto a step ladder, either a folding step ladder or an extension ladder that can be used to transport the step ladder from place to place support the outer end of the ladder. Specifically, a plate can be permanently fixed to one side leg of a ladder, with a wheel set or assembly removably mounted on the plate, so the wheels can be removed for storage or when not wanted on the ladder.

Various wheeled dollies have been used for different types of ladders and other equipment. U.S. Pat. No. 6,708,993 illustrates a ladder dolly used in connection with ladders having hollow rungs opening to side rails of the ladder.

Folding step ladders and some extension ladders have solid side rails and rungs, and the present device is useful for such ladders.

SUMMARY OF THE INVENTION

The present invention relates to a ladder dolly that can be used in connection with folding step ladders and extension ladders, particularly those which do not have a hollow rung opening through the side rail of the ladder.

A mounting plate is securely fixed to an outer surface of a side rail of a ladder, adjacent one end of the ladder. A removable wheel assembly has a frame which is removably supported on mating interfitting parts between the wheel assembly and the support plate. The wheel assembly can be removed and reinstalled on the plate quickly with a latch assembly. This lets a user of the ladder remove the wheel assembly if it will be in the way, or for storage, so that the ladder takes less space.

If the ladder is to be used for a period of time for one location, it may be desirable to remove the wheel assembly temporarily while the ladder is in use. Removal of the wheels reduces the required width of the ladder. Removal for storage also saves space.

DETAILED DESCRIPTION OF THE ILLUSTRATIVE EMBODIMENT

Figure 1:
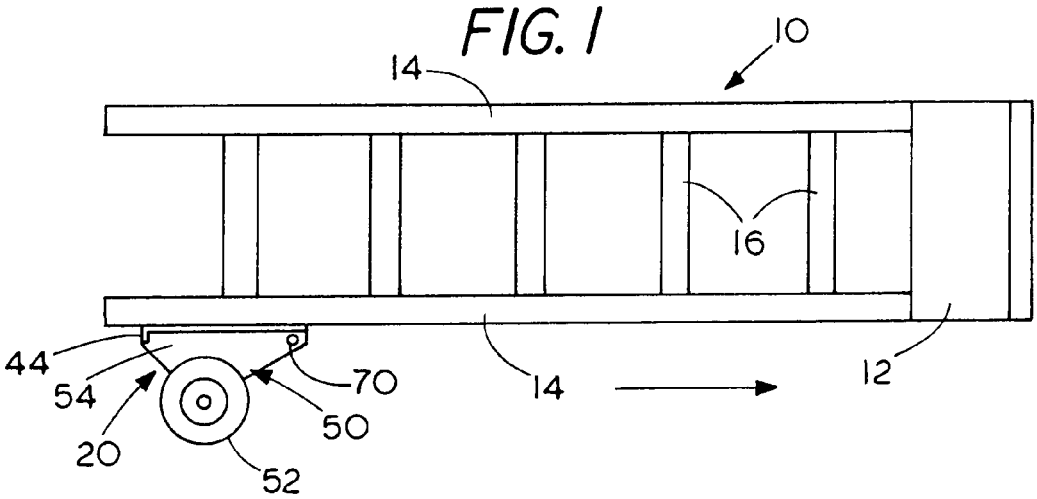
FIG. 1 is a side view of a step ladder having a wheeled attachment made according to a first form of the present invention.

In FIG. 1, a folding step ladder 10 of conventional design is shown this figure, and it has a top end bracket 12 that is used as a mounting base for mounting a pair of main step support legs or rails 14, with cross steps 16 thereon. The main support legs 14 are spaced apart as shown in FIG. 1, and a mobile dolly or wheeled transport is illustrated generally at 20.

Figure 2:
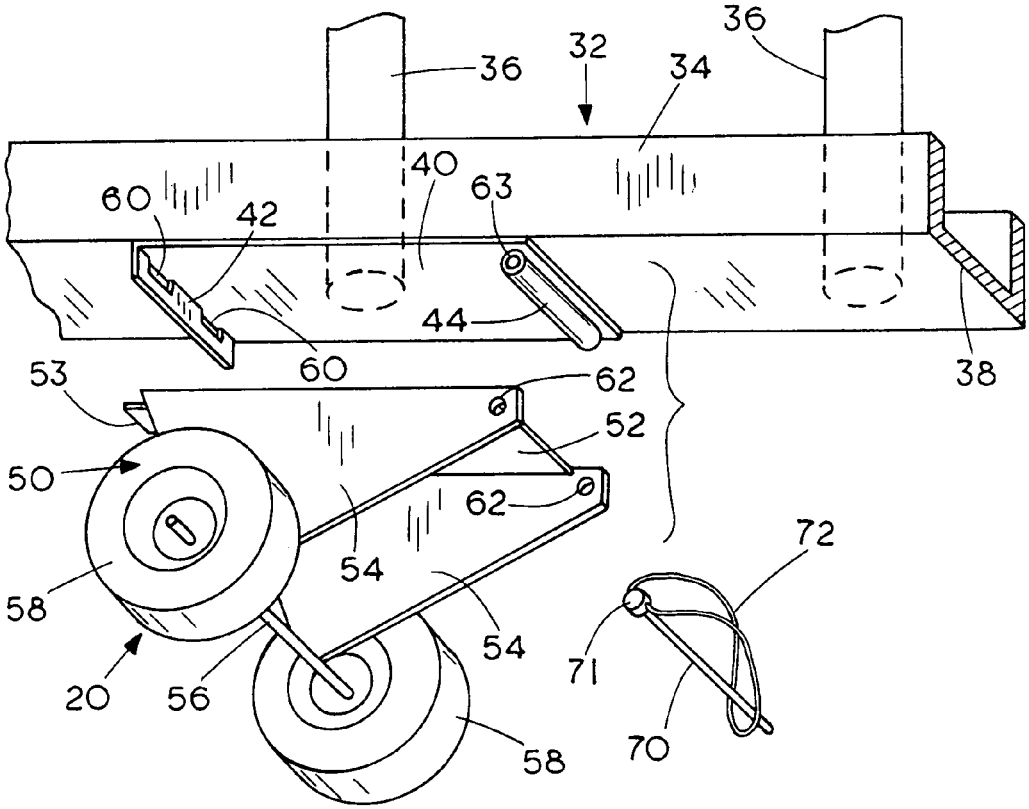
FIG. 2 is an exploded view of the wheeled attachment of FIG. 1 shown on a regular extension step ladder.

The wheeled transport 20 is also shown in more detail in FIGS. 2–5. In FIG. 2 the wheeled dolly 20 is shown in connection with a conventional ladder 32 that has a side rail 34, with cross rungs 36 mounted on the base wall 38 of the channel shaped ladder side rails 34. The base wall 38 can be any desired configuration, but generally is planar.

The wheeled dolly or transport 20 includes a base plate 40 that is secured with double sided tape, rivets, bolts, adhesives or in other ways, to permanently affix the base plate 40 to the base or outer wall 38 of the ladder side rail, on the outer surface of the base wall. The base plate 40 has a bent down flange 42, at one end, and a cross tube 44 fixed at the other end of the plate. The cross tube 44 is fixed to the plate 40 by welding or other secure holding arrangement.

Figure 3:
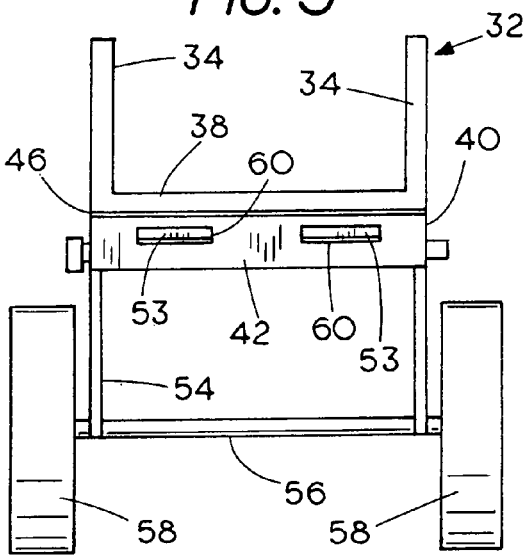
FIG. 3 is an end view of the device of FIG. 2, viewed from a left end thereof.
Figure 4:
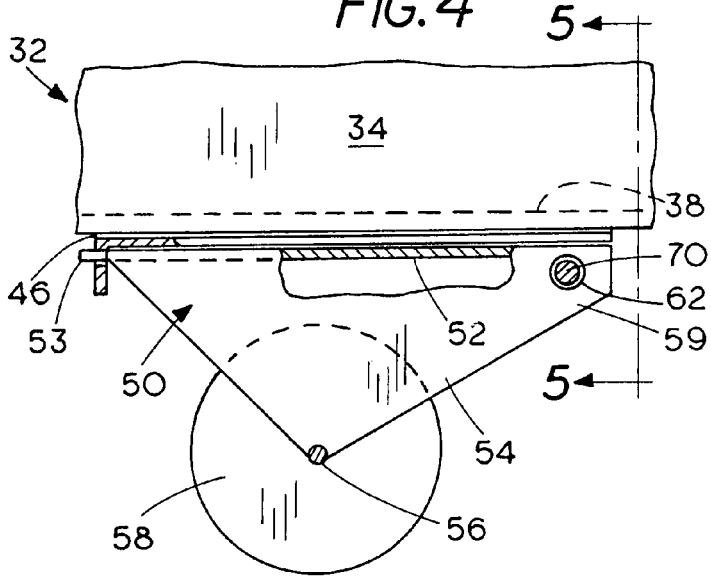
FIG. 4 is a side view of the device of FIG. 3.
Figure 5:
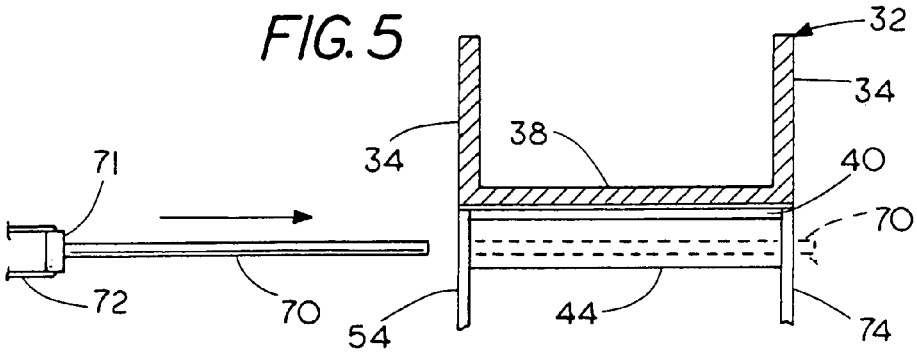
FIG. 5 is an end view at the opposite end shown in FIG. 3, with parts broken away.

As can be seen in FIGS. 3, 4, and 5, the plate 40 is secured to the base wall 38 with a layer of adhesive or one or more strips of a double sided, pressure sensitive tape 46. The layer 46 could be merely an adhesive coating that would hold the plate 40 tightly onto and permanently affixed to the base wall 38 of the ladder side rail 34.

The plate 40 will remain with the ladder 32 or step ladder 10, but a removable wheeled support 50 can be removed from the plate 40. As shown, the wheeled support 50 includes a top wall 52, and a pair of side flanges or skirt walls 54 that are fixed to the top wall 52. The side walls 54 support an axle 56 that spans or extend between the side walls 54, and a pair of wheels 58 (dual wheels) are rotatably mounted on the frame on opposite ends of the axle 52 and positioned to the outsides of the side walls 54.

In addition, the top wall 52 of the support 50 has a pair of tongue members or tabs 53 that are of size to fit into slots 60 on the depending flange 42 of the base wall or base plate 40 that is fixed to the ladder side rail. The side walls 54 of the wheeled support 50 have a forwardly projecting portion that extends beyond the end of the top wall 52 of the support. Apertures 62 are provided in the projecting portions of the side walls 54.

The wheeled support 50 can be installed on the base plate 40 when the base plate is in place on the ladder by tilting the top plate 52 of the wheeled support so that the tongue members or tongues 53 can be slipped into the slots 60, and then the plate 52 rotated up so that the projecting ends 59 of the skirts or side walls 54 have apertures slide up on opposite ends of the cross tube 44. The apertures 62 will align with the bore or opening 63 in the tube 44 (FIG. 2).

A long pin 70 is inserted through the apertures 62 and the bore 63 of the cross tube 44 to hold the wheeled support 50 in place. The pin 70 has a locking member 72 thereon, which as shown is a spring loop that can be fastened around the end of the pin opposite from a head end 71 of the pin.

The base plate 52 is permanently installed on the ladder side rail, as shown, and then the wheeled support 50 can be easily installed and removed when desired. The plate 40 remains with the ladder, and the wheels can be removed for storage so they are not in the way. The plate is positioned near one end of the ladder and the other end can be lifted to wheel the ladder from place to place.

Figure 6:
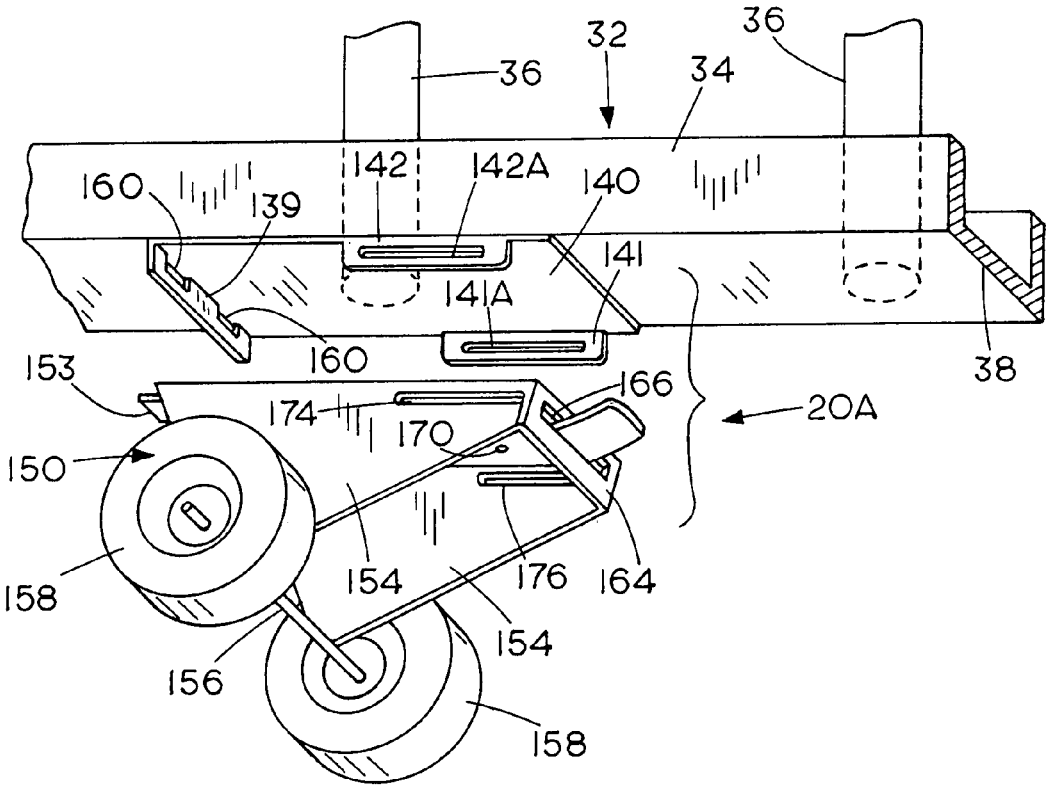
FIG. 6 is an exploded view of a second form of a latch for attaching a wheel assembly to a base.
Figure 7:
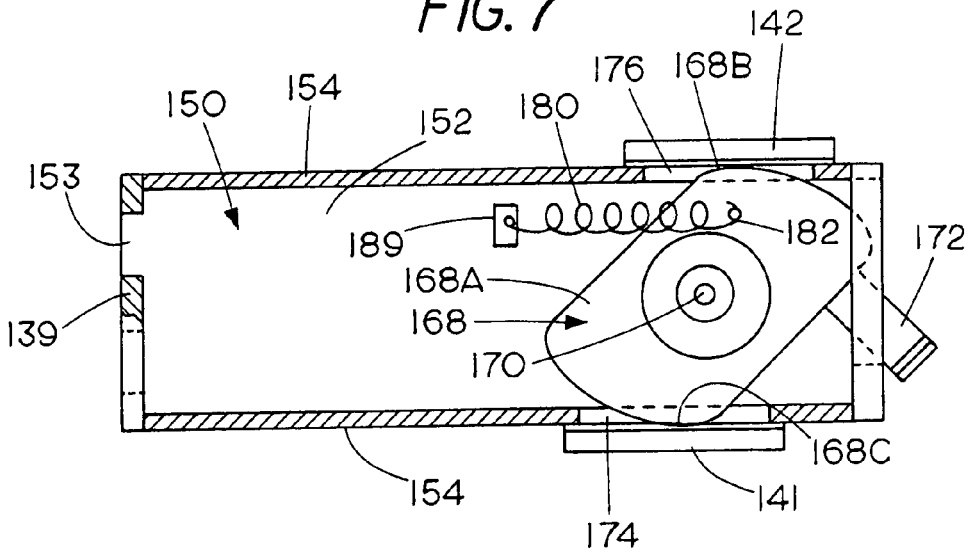
FIG. 7 is a bottom plan view of the assembly of FIG. 6 with the latch in an open position.
Figure 8:
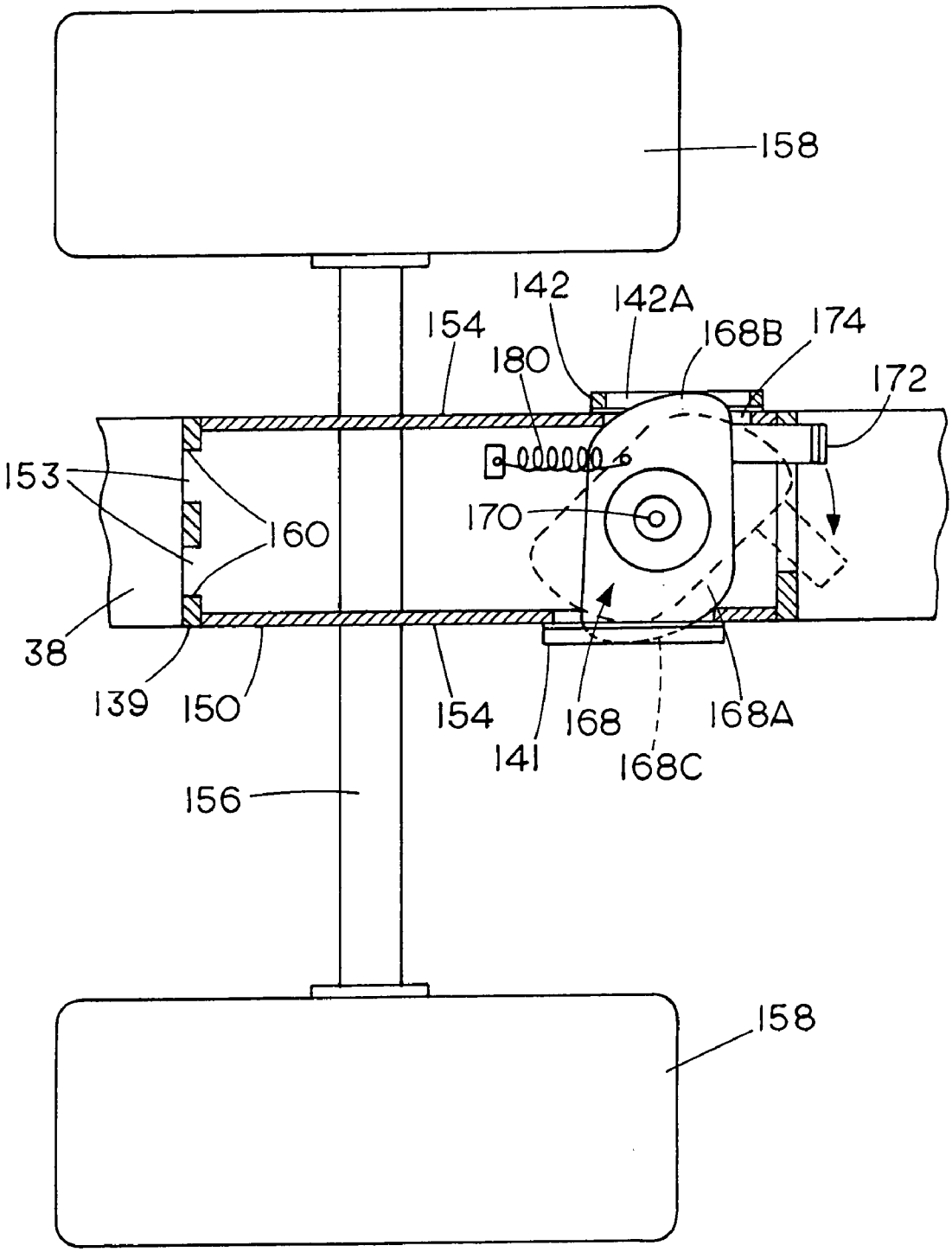
FIG. 8 is a view similar to FIG. 7 with the latch closed.

FIGS. 6, 7 and 8, a modified form of the invention is illustrated with a different latch system for holding the wheel assembly in place.

In FIG. 6, the wheeled dolly indicated generally at 20A is shown in an exploded view adjacent a conventional ladder 32 that has channel shaped side rails 34, with cross rungs 36 mounted on the base wall 38 of the channel shaped side rails 34. Base wall 38 can be of any desired configuration, but generally planar as shown.

Transport dolly 20A includes a base plate 140 that is secured to the side rail 34 of the ladder in a suitable manner, such as with rivets, bolts, adhesives, tape, or in other ways to affix the base plate 140 to the base or wall 38 of the ladder side rail. The base plate 140 in this form of the invention has a bent down end flange 139, which corresponds to the bent down flange 42 in the first form. The bent down end flange 139 is at one of the base plate 140. There are a pair of side flanges 141 and 142 near an opposite end of the base plate, which extend down from opposite sides of the base plate. The side flanges 141 and 142 are staggered or offset from each other in a longitudinal direction. The bent down side flanges 141 and 142 have longitudinally extending slots 141A and 142A formed therein. The side flanges can be formed in any way as long as they are fixed to the sides of the base plate 140.

Side flanges 141 and 142 are spaced apart sufficiently to receive a wheeled support assembly 150 that includes top wall 152 (see FIGS. 7 and 8), and a pair of side flanges or skirt walls 154, that are spaced apart, which spacing, with the top wall 152, is such that the wheel support will slip between the side flanges 141 and 142 on the base plate 140. The side walls 154 support a cross axle 156 in a suitable manner, and the cross axle 156 has rotatably mounted wheels 158 at opposite ends thereof, to the outside of the side walls 154.

The top wall 152 of the wheel support 150 has a pair of tongue members or tabs 153 that extend outwardly from the top wall, and fit into slots 160 that are formed in the end flange 139 at essentially the same spacing as the slots 60 in the first form of the invention.

In this form of the invention, the tongue members or tabs 153 will slip into the slots 160, and the opposite end portion of the top wall 152 of the wheel support 150 can then be swung up to be in contact with the attached plate 140. The opposite end of the top wall 152 of the wheel support 150 from the tongue members 153 has a depending latch flange 164 thereon, and this latch flange 164 has a cross slot 166. A pivoting latch member 168 is pivotally mounted to the top wall 152 with a suitable pivot pin 170 (See FIGS. 7 and 8), and the latch member 168, as can be seen, is shaped as a cam with a plate portion 168A that has rounded opposite end portions 168B and 168C. In addition, the plate portion 168A has a manual lever 172 that extends out of the slot 166, so that the end of the latch lever 172 may be used to pivot the latch 168 about the axis of pivot pin 170.

The side walls 154,154 of the wheel support also have slots 174 and 176 therein, so that the rounded end portions 168B and 168C will pass through the slots 174 and 176, and when the latch 168 is moved so that the plate 168A moves its position shown in FIG. 8, the rounded cam end portions 168B and 168C will pass through the slots 174 and 176 of the side flanges 154, and will engage or enter the slots 141A and 142A to provide for a locking of the wheel support 150 relative to the base plate 140. The pivot pin 170 is positioned so that the cam action of the locking plate 168A will cause the end portions 168B and 168C to protrude through the aligned slots. This is shown for the rounded portion 168B, in particular in FIG. 8, where the flange 142 is broken away to show the slot 142A.

Likewise, the side plate 154 on that side is broken away to show the slot 174 through which the rounded portion 168B passes. The same locking or latching action occurs on the opposite side of the plate 140 so that the rounded end or cam end 168C will pass through the slot 176 and into the slot 141A to lock the wheel support 150 against the plate 140 when the tabs or tongue members 153 are in the slots 160.

The latch member 168 is urged to its latched position with a coil spring shown schematically at 180 that is attached as at 182 to the plate 168A, and to a bracket 184 that is mounted on the wall 152, so that the tension spring 180 will urge the latch 168 to its latched position. Manually moving the lever 172 will permit an operator to insert the tongues or tabs 153 into the slots 160, and then pivot the wall 152 up against the plate 140, while the latch 168 is held in its open position shown in FIG. 7, and then releasing and/or manually moving the latch 168 to its latched position shown in FIG. 8 with lever 172. This latching holds the wheel assembly 150 securely in place on plate 140 and thus on the ladder.

The rounded end portions 168B and 168C that engage the slots 141A and 141B can be angled or have cam like surfaces thereon, so that as the latch is pivoted to its locked position, it will tighten the wall 150 against the base plate 140, much like a window latch of a double hung window.

The second form of the invention is a form that permits rapid installation and removal of the wheel support 150 without a separate pin, but accomplishes the same purposes as a latch in the first form of the invention.

If the ladder is going to be used in one location, the wheeled support 50 or 150 can be removed so the wheels are not extending out from the side of the ladder during use. When the ladder is to be moved from one location to another, the wheeled support 50 or 150 is put into position on plate 40 or 140 and the ladder placed on edge so the wheels are on the ground. The wheeled support is preferably located adjacent one end of the ladder and the other end is lifted and the ladder rolled along on the wheels to the new location. Transporting heavy ladders over the ground can be done by one person with the present dolly. The ability to remove the wheels make for convenience for ladders without hollow rungs. The wheel sizes can be selected as desired, and the plates 40 or 140 can be varied in length and width to suit existing ladders.

Although the present invention has been described with reference to preferred embodiments, workers skilled in the art will recognize that changes may be made in form and detail without departing from the spirit and scope of the invention.

What is claimed is:

1. A wheeled support for transportation of a ladder having a plurality of foot supports extending between a pair of spaced apart longitudinally extending side rails, the wheeled support comprising a frame including at least one support wheel rotatably mounted on the frame, a mounting plate defining a plane securable to an outer side surface of a side rail of a ladder, and the mounting plate having a flange extending outwardly from the side rail at one end, the flange having at least one slot therein, and a retainer having an opening fixed adjacent an opposite end of the mounting plate, the frame having a top plate that has at least one tongue on an end thereof that fits into the at least one slot on the flange, a portion of the frame having an aperture aligning with the opening of the retainer on the mounting plate with the at least one tongue in the at least one slot, and a latch member passing through the aperture and into the opening to secure the frame to the mounting plate.

2. The wheeled support of claim 1, wherein the retainer comprises a pair of flanges along sides of the mounting plate, each with an opening, and the openings comprise slots through which the latch member that is pivotally mounted on the top plate extends in a latched position.

3. The wheeled support of claim 1, wherein said retainer comprises a sleeve having a bore comprising the opening, and the latch member comprises a pin passing through the aperture and into the bore of the sleeve.

4. The wheeled support of claim 2, wherein said latch member is pivotally mounted and has a manual lever extension for pivoting the latch member between a latched and unlatched position.

5. The wheeled support of claim 4, wherein the latch member comprises a latch plate that has rounded end portions that act as cams, and in one pivoted position, the end portions clear the openings in the flanges, and in a latched position, the rounded end portions project when the latch plate is pivoted to the openings in the flanges, respectively.

6. The wheeled support of claim 1, wherein said frame has a pair of side skirt members that extend from the top plate, and an axle mounted at ends of said skirt members opposite from the top plate for rotatably mounting the at least one wheel.

7. A ladder support comprising a mounting plate securable to an outer side edge of a ladder side rail, the mounting plate having a planar surface adapted for securing directly to the outer side edge of a ladder and to be generally perpendicular to foot supports on the ladder on which the mounting plate is mounted, a cross pin receptacle at one end of the mounting plate, and a depending flange extending outwardly from the mounting plate at an opposite end of the mounting plate, said depending flange having at least one slot therein, and a wheeled support comprising a frame having a base plate with at least one tongue member at one end of the base plate for fitting into the at least one slot, said base plate fitting between the cross pin receptacle and the flange, and the frame having an aperture at a second end of the frame aligning with the cross pin receptacle for receiving a pin to hold the mounting plate and the frame in assembly with the at least one tongue engaging the at least one slot.

8. The ladder support of claim 7 wherein the pin has a securing device to hold it the receptacle and aperture.

9. The ladder support of claim 8 and a pair of skirt walls attached to the base plate and wherein the wheeled support comprises a wheel and axle assembly mounted on the skirt walls.

10. An apparatus comprising a ladder assembly, said ladder assembly having a pair of side rails that are spaced apart, and a plurality of steps extending between the side rails, each of said side rails having an outer side surface, a wheel support supporting a first end of the ladder assembly, said wheel support including a mounting plate fixed to a width of a side surface of one of the side rails at the first end of the ladder, said mounting plate having a receptacle adjacent one end thereof, and a flange extending outwardly from the mounting plate at an opposite end thereof, a slot in said flange, a wheel carrying frame having a top plate that extends between the receptacle and the flange, and with a tongue member on the top plate positioned in the slot of the flange, the frame having an aperture for releasably receiving a movable latch that passes through the apertures and into the receptacle to secure the frame to the mounting plate, and at least one wheel rotatably mounted on the frame at a position spaced from the mounting plate, and rotatable about an axis such that a second end of the ladder can be lifted and towed while the first end of the ladder is supported on the at least one wheel, and wherein the at least one wheel rolls as the ladder is towed.

11. The apparatus of claim 10, wherein said latch comprises a pin that passes through the aperture and into the receptacle.

12. The apparatus of claim 10, wherein the receptacle comprises a slot formed in a flange that depends from the mounting plate on a side thereof, and the latch comprises a pivoting cam member that is mounted on the top plate of the frame and is pivotable from a position wherein a portion of the latch member enters into the slot on the flange to a position wherein the latch member clears the slot in the flange.

13. The apparatus of claim 12, wherein said top plate of the frame has side skirts depending therefrom, and at least one of the side skirts having a slot aligning with the slot in the flange, and the latch member passing through the slot in the at least one side plate and into the slot in the flange when the latch member is in its latched position.

14. The apparatus of claim 13 further characterized by the latch member being pivotally mounted on an underside of the top plate, and a manual lever extending from the latch member for manually pivoting the latch member.

* * * * *